US006114938A

United States Patent [19]

Iida et al.

[11] Patent Number: 6,114,938

[45] Date of Patent: Sep. 5, 2000

[54] VARIABLE INDUCTOR DEVICE

[75] Inventors: Naoki Iida, Sabae; Kazuyoshi Uchiyama, Fukui-ken; Katsuji Matsuta, Sabae; Masahiko Kawaguchi, Takefu, all of Japan

[73] Assignee: Murata Manufacturing Co., Ltd., Kyoto, Japan

[21] Appl. No.: 09/187,279

[22] Filed: Nov. 6, 1998

[30] Foreign Application Priority Data

Nov. 11, 1997 [JP] Japan ..... 9-309082

[51] Int. Cl.[7] ..... H01F 5/00

[52] U.S. Cl. ..... 336/200; 336/232; 257/531

[58] Field of Search ..... 336/200, 223, 336/232; 257/531; 29/602.1; 333/181, 185

[56] References Cited

U.S. PATENT DOCUMENTS

| | | | |
|---|---|---|---|
| 4,573,101 | 2/1986 | Takeno | 361/321 |
| 4,888,568 | 12/1989 | Kawaguchi | 333/174 |
| 5,015,975 | 5/1991 | Okubo | 333/185 |
| 5,034,710 | 7/1991 | Kawaguchi | 333/185 |
| 5,532,656 | 7/1996 | Yoshimura | 333/185 |
| 5,572,180 | 11/1996 | Huang et al. | 336/200 |
| 5,578,981 | 11/1996 | Tokuda | 336/171 |
| 5,699,025 | 12/1997 | Kanoh et al. | 333/177 |

*Primary Examiner*—Lincoln Donovan
*Assistant Examiner*—Tuyen Nguyen
*Attorney, Agent, or Firm*—Keating & Bennett, LLP

[57] ABSTRACT

A variable inductor device has at least two coils. The at least two coils are disposed on an insulating substrate with an inductance adjusting element located therebetween. The inductance adjusting element is electrically connected at one end to a tap center electrode. The at least two coils are electrically connected to each other via the inductance adjusting element. The inductance adjusting element is grooved and horizontal paths of the inductance adjusting element are sequentially disconnected one by one by, for example, a laser beam. The inductances are thus varied. It is therefore possible to provide a variable inductor device in which the area required for mounting the device on a printed circuit board is decreased and the inductances are stably adjusted while keeping the inductances balanced.

25 Claims, 13 Drawing Sheets

VARIABLE INDUCTOR DEVICE

BACKGROUND OF THE INVENTION

1. Field of the Invention

The present invention generally relates to variable inductor devices and, more particularly, to variable inductor devices used in mobile communication units.

2. Description of the Related Art

In electronic equipment which must be miniaturized and more particularly in mobile communication units such as mobile cellular telephones and automobile telephones, there is a demand for reducing the size of components used therein. As the frequency in a mobile communication unit is increasing, the circuitry is becoming more complicated, and thus, only a small deviation is allowed for the components used in the unit.

In order to obtain a circuit having a tap center connected to the electrical midpoint of a coil, the following configuration is conventionally used, as illustrated in FIG. 25. Two coil components 201 and 202 are mounted on a printed circuit board 206 and are electrically connected to each other via circuit patterns 203 and 204 and a tap center pattern 205 is provided on the printed circuit board 206. Further, the following methods have been proposed to vary the inductances of the coil components 201 and 202 while keeping the inductances in balance with each other. The coil components 201 and 202 are simply replaced with alternative coil components having different and properly balanced inductances. Alternatively, variable coils are used as the coil components 201 and 202 to gradually and suitably vary the inductances of the coils.

In the above methods, however, the inductances of the two coil components 201 and 202 cannot be properly balanced because of variations in the inductances of the coil components 201 and 202 and a positional displacement in mounting the coil components 201 and 202. This may sometimes cause the tap center pattern 205 to be connected to a portion deviating from the electrical midpoint of the coil which is formed by the coil components 201 and 202. Further, as noted above, the coil components 201 and 202 are electrically connected to each other via the tap center pattern 205 disposed on the printed circuit board 206, thereby requiring that an overall area printed circuit board 206 be very large.

Moreover, according to the first conventional method for varying the inductances by replacing the coil components 201 and 202 with alternative coil components, the removing operation of the coil components 201 and 202 is very complicated, thereby making it hard to automate the required operation. On the other hand, according to the second conventional method for varying the inductances of the variable coils while keeping them in balance with each other, the adjusting operation is very complicated and troublesome. Because of this reason, it is difficult to automate the required operation.

SUMMARY OF THE INVENTION

To overcome the problems described above, preferred embodiments of the present invention provide a variable inductor device having at least two coils in which a large area of a printed circuit board is not required and the inductances of the coils are easily and reliably adjustable while keeping inductances in balance with each other.

According to a specific preferred embodiment of the present invention, there is provided a variable inductor device including (a) an insulating substrate; (b) at least first and second coils provided on or within the insulating substrate; (c) an inductance adjusting element provided on or within the insulating substrate and connecting a first end of the first coil to a first end of the second coil, the inductance adjusting element being trimmed to adjust inductances; (d) input/output external electrodes provided on or within the insulating substrate and electrically connected to second ends of the first and second coils, respectively; and (e) a tap center electrode provided on or within the insulating substrate and electrically connected to one end of the inductance adjusting element.

The coils may be formed in a spiral, helical, meandering or linear arrangement. The inductance adjusting element may be a ladder electrode or a solid electrode. Further, the ladder electrode may have a vertical path at the approximate center of the electrode. Moreover, the inductances of the respective coils may be equal to or different from each other, and the coils may have different shapes.

The coils and the inductance adjusting element may be provided on the insulating substrate via a thin-film forming method or may be provided inside the insulating substrate via a sheet-processing technique or a printing technique. Further, the coils and the inductance adjusting element may be disposed side by side on the same surface of the insulating substrate, and the coils may be positioned symmetrically with respect to the inductance adjusting element. Alternatively, the coils and the inductance adjusting element may be disposed on different surfaces of the insulating substrate. For example, the inductance adjusting element may be disposed on the obverse surface of the insulating substrate, while the coils may be placed inside the insulating substrate. The terminating end of the first coil viewed from the corresponding input/output external electrode may be positioned near the second coil, while the terminating end of the second coil viewed from the corresponding input/output external electrode may be positioned in the vicinity of the first coil. The number of windings of each of the coils may be set to be 1.5 or more turns if the coils have a spiral shape.

According to the variable inductor device of preferred embodiments of the present invention, the inductance between the input/output external electrodes and the inductance between each of the input/output external electrode and the tap center electrode may be easily and accurately varied by trimming the inductance adjusting element. Alternatively, the inductance between the input/output external electrodes may be easily and accurately varied by trimming the inductance adjusting element without changing the inductance between each of the input/output external electrodes and the tap center electrode. During the above operation, the inductances of the respective coils may be desirably changed at a constant ratio.

According to the variable inductor device of preferred embodiments of the present invention, the input/output external electrodes may be each provided on one lateral surface on a width side of the insulating substrate, while the tap center electrode may be provided at the approximate center of one lateral surface on a length side of the insulating substrate. Alternatively, input/output external electrodes may be each disposed on one lateral surface on a width side of the insulating substrate, while the tap center electrode may be disposed on the other lateral surface on the width side of the insulating substrate.

With the above arrangements, by trimming the inductance adjusting element, the inductance between the input/output external electrodes respectively connected to the coils or the inductance between each of the input/output external electrode and the tap center electrode may be varied without disturbing the balance between the inductances of the coils.

These and other elements, features, and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

A variable inductor device according to preferred embodiments of the present invention will now be described with reference to the accompanying drawings while also referring to the manufacturing method.

Figure 1:
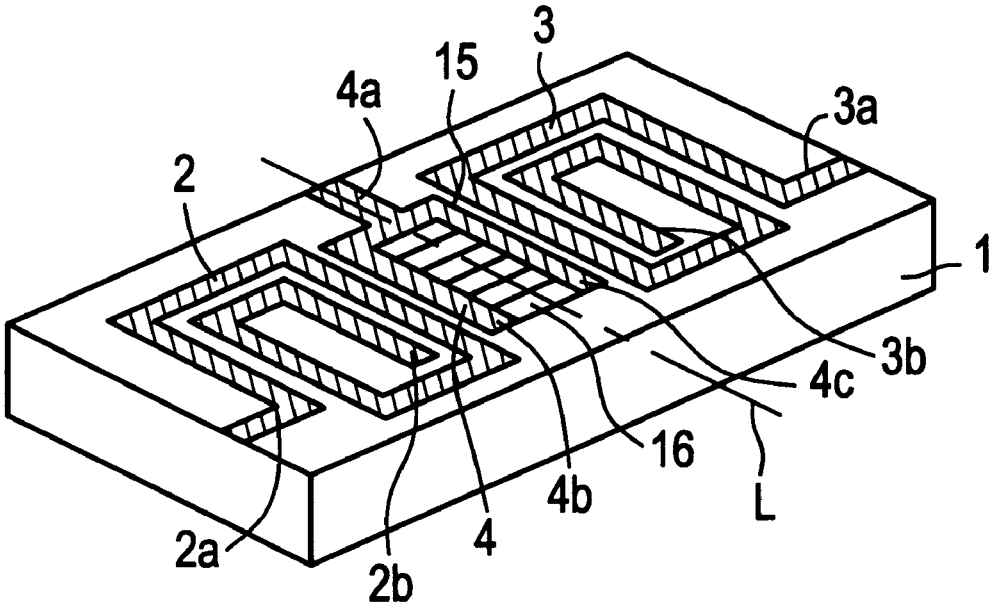
FIG. 1 is a perspective view illustrating a variable inductor device according to a first preferred embodiment of the present invention.

A reference will first be made to FIG. 1. After the upper surface of an insulating substrate 1 is polished, spiral coils 2 and 3 and an inductance adjusting element 4 are formed on the upper surface of the insulating substrate 1 via a thick-film printing method or a thin-film forming method, such as a photolithographic technique. The thick-film printing method is performed, for example, in the following manner. After a masking material provided with an opening having a predetermined pattern covers the upper surface of the insulating substrate 1, a conductive paste is applied to the masking material. Thus, a conductor having a comparatively thick-film pattern (the coils 2 and 3 and the inductance adjusting element 4 in the first preferred embodiment) is formed on the upper surface of the insulating substrate 1 by being exposed through the opening of the masking material.

A thin-film forming method, such as a photolithographic technique, may be used in the following manner. After a relatively thin conductive film is formed on substantially the entire upper surface of the insulating substrate 1, a resist film (for example, a photosensitive resin film) is deposited on substantially the entire conductive film via spin-coating or printing. Subsequently, a mask film having a predetermined image pattern covers the upper surface of the resist film, which is then irradiated with, for example, ultraviolet rays, thereby partially curing the resist film. After the resist film, except for the cured portion, is stripped, the exposed portion of the conductive film is removed to form a conductor having a predetermined pattern (the coils 2 and 3 and the inductance adjusting element 4 in this preferred embodiment). The cured resist film is then removed.

According to another photolithographic technique, a photosensitive conductive paste may be applied to the upper surface of the insulating substrate 1, which may then be coated with a mask film having a predetermined image pattern. The mask film is then exposed to light and developed.

Referring back to FIG. 1, the inductance adjusting element 4 preferably includes a ladder electrode having a generally U-shaped frame portion 15 and a plurality of horizontal paths 16 bridging two arms of the frame portion 15. The inductance adjusting element 4 is disposed substantially at the approximate center of the insulating substrate 1. One end (the distal end) 4*a* of the inductance adjusting element 4 is extended to the distal side of the insulating substrate 1, as viewed from FIG. 1. The spiral coils 2 and 3 preferably having substantially the same dimensions are respectively located on the left and right sides of the insulating substrate 1 with the inductance adjusting element 4 located therebetween. One end (the outer end) 2*a* of the coil 2 is extended to the left side of the insulating substrate 1, while one end (the outer end) 3*a* of the coil 3 is extended to the right side of the substrate 1. The inductance adjusting element 4 is preferably axially symmetrical, and the coils 2 and 3 arranged symmetrically relative to each other with respect to the axis L of the inductance adjusting element 4. The inductances of the respective coils 2 and 3 are preferably set to be substantially equal to each other.

As the material for the insulating substrate 1, glass, glass ceramic, alumina, or ferrite may be used. As the material for the coils 2 and 3 and the inductance adjusting element 4, Ag, Ag-Pd, Cu, Au, Ni, or Al may be used.

Figure 2:
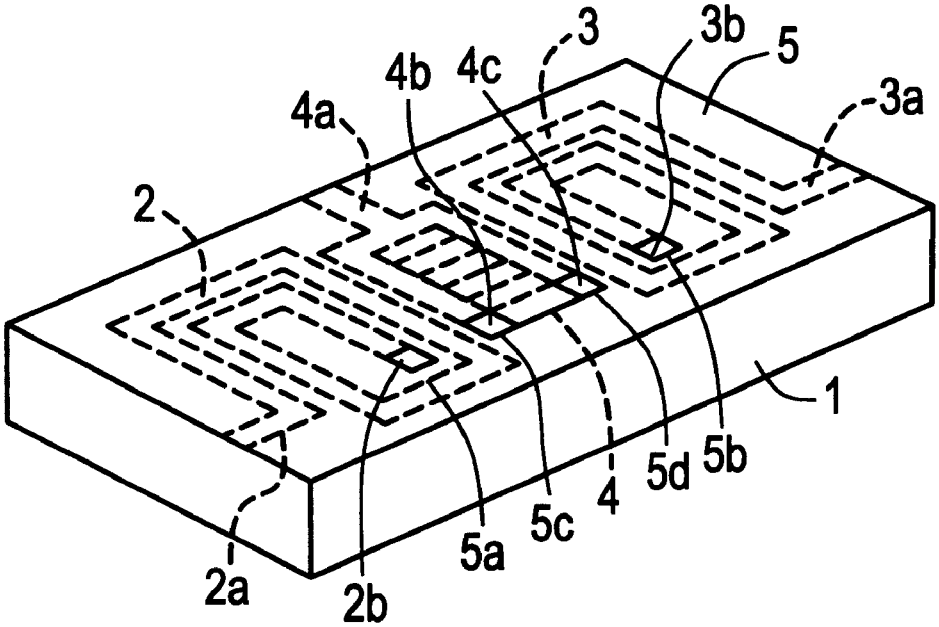
FIG. 2 is a perspective view illustrating the manufacturing step of the variable inductor device subsequent to the step shown in FIG. 1.

Subsequently, an insulating protective film 5 having openings 5*a* through 5*d* is formed, as shown in FIG. 2, according to the following photolithographic technique. A liquid insulating material is applied to the entire upper surface of the insulating substrate 1 via spin-coating or printing, and dried, thereby forming the insulating protective film 5. A material suitable for photolithography, such as a photosensitive polyimide resin, is used for the insulating material. Thereafter, a mask film having a predetermined image pattern covers the upper surface of the insulating protective film 5, which is then partially cured by applying, for example, ultraviolet rays. Then, the uncured portions of the insulating protective film 5 are removed to form the openings 5*a* through 5*d*. The inner ends 2*b* and 3*b* of the spiral coils 2 and 3 are exposed to the openings 5*a* and 5*b*, respectively. The proximal ends 4*b* and 4*c* located opposite to the distal end 4*a* of the inductance adjusting element 4 are exposed to the openings 5*c* and 5*d*, respectively.

Figure 3:
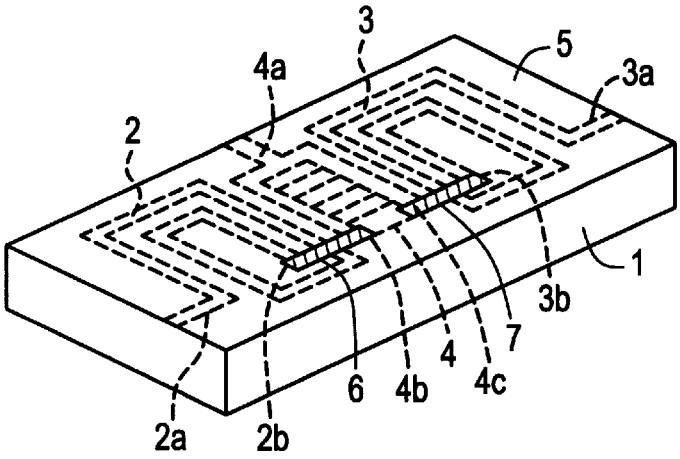
FIG. 3 is a perspective view illustrating the manufacturing step of the variable inductor device subsequent to the step shown in FIG. 2.

Thereafter, relay electrodes 6 and 7 are formed, as illustrated in FIG. 3, according to a thick-film printing method or a thin-film forming method, such as a photolithographic technique, as in the formation of the coils 2 and 3. The relay electrode 6 electrically connects the inner end 2*b* of the coil 2 to the proximal end 4*b* of the inductance adjusting element 4 via the openings 5*a* and 5*c* of the insulating protective film 5. The relay electrode 7 electrically connects the inner end 3*b* of the coil 3 to the proximal end 4*c* of the inductance adjusting element 4 via the openings 5*b* and 5*d* of the insulating protective film 5.

Figure 4:
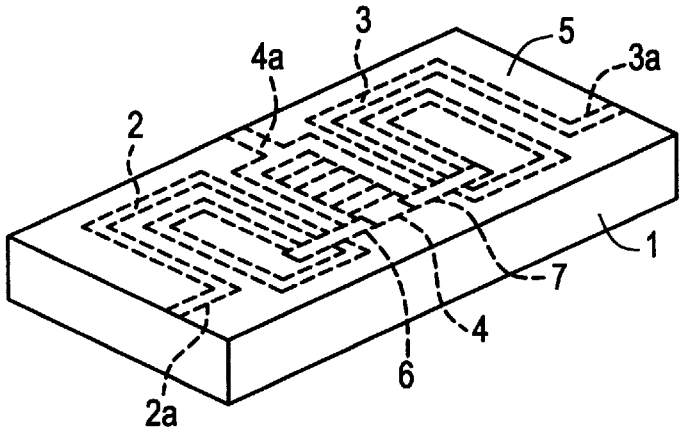
FIG. 4 is a perspective view illustrating the manufacturing step of the variable inductor device subsequent to the step shown in FIG. 3.

As shown in FIG. 4, a liquid insulating material is then applied to substantially the entire upper surface of the insulating substrate 1 via spin-coating or printing, and dried, hereby forming the insulating protective film 5 that covers the relay electrodes 6 and 7.

Figure 5:
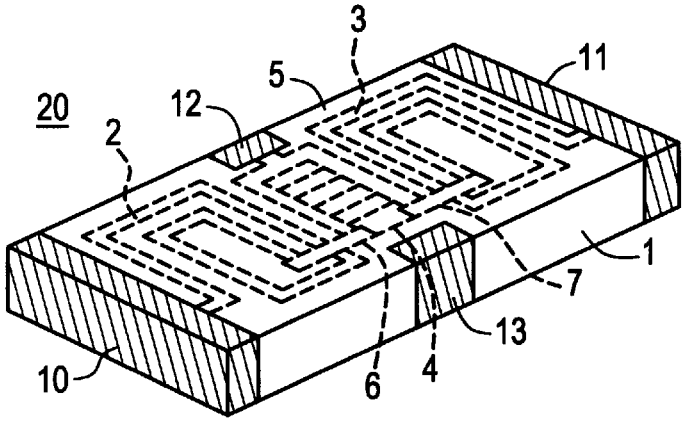
FIG. 5 is a perspective view illustrating the manufacturing step of the variable inductor device subsequent to the step shown in FIG. 4.

Input/output external electrodes 10 and 11 are then disposed, as illustrated in FIG. 5, over the left and right surfaces, respectively, of the insulating substrate 1. The input/output external electrode 10 is electrically connected to the outer end 2*a* of the coil 2, while the input/output external electrode 11 is electrically connected to the outer end 3*a* of the coil 3. Further, a tap center electrode 12 and a reinforcing dummy electrode 13 for soldering are, as shown in FIG. 5, respectively provided on the distal lateral surface and the proximal lateral surface of the insulating substrate 1. The tap center electrode 12 is electrically connected to the distal end 4*a* of the inductance adjusting element 4. The electrodes 10 through 13 formed as described above are produced by applying and baking, or dry-plating a conductive paste made from, for example, Ag or Ag-Pd.

Figure 6:
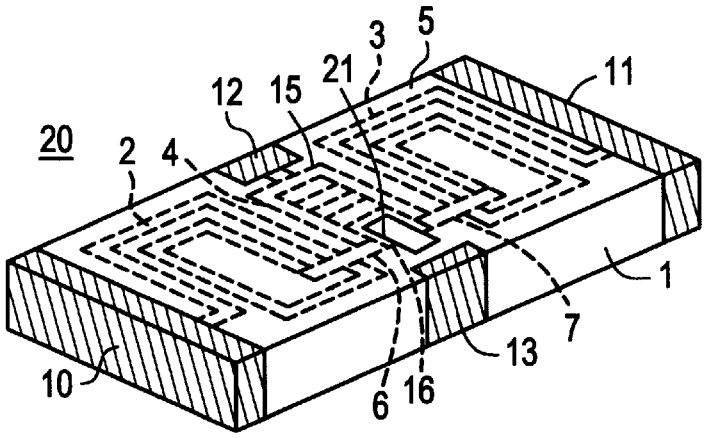
FIG. 6 is a perspective view illustrating the inductance adjusting method of the variable inductor device shown in FIG. 5.
Figure 7:
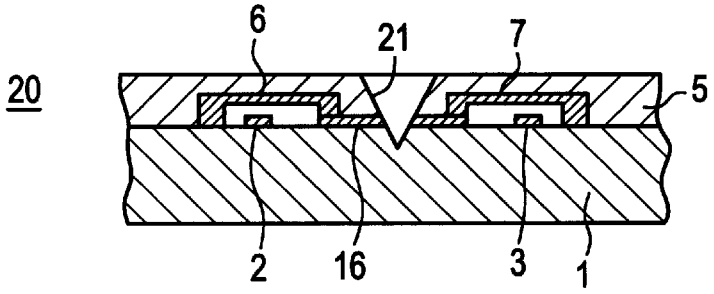
FIG. 7 is a partially sectional view illustrating the variable inductor device shown in FIG. 6.

A variable inductor device 20 is thus obtained by the foregoing procedure. The circuitry of the inductor device 20 is configured in such a manner that the two coils 2 and 3 are electrically connected on the insulating substrate 1 via the relay electrodes 6 and 7 to the inductance adjusting element 4 disposed between the coils 2 and 3, respectively. After the variable inductor device 20 is mounted on a printed circuit board, the inductance adjusting element 4 is trimmed. More specifically, by applying, for example, a pulsating laser beam to the upper surface of the variable inductor device 20, a groove 21 is formed in the inductor device 20, as shown in FIGS. 6 and 7, and the horizontal paths 16 are electrically disconnected one by one from the proximal path 16 to the distal path 16 of the inductance adjusting element 4 (FIG. 6 shows that the two horizontal paths 16 have been disconnected). With this arrangement, the inductance between the inpu/output external electrodes 10 and 11 is easily varied in stages without changing the inductance between each of the input/output external electrodes 10 and 11 and the tap center electrode 12.

The inductance adjusting element 4 may be trimmed by any means, such as, not only a laser beam but also sand blasting or any other suitable trimming method. The formation of the groove 21 is not essential as long as the horizontal paths 16 are electrically disconnected. The same applies to the following preferred embodiments.

Accordingly, the horizontal paths 16 of the inductance adjusting element 4 have been arranged in such a manner that the inductance between the input/output external electrodes 10 and 11 is varied in stages with given pitches. It is thus possible to provide a variable inductor device 20 which is capable of regulating the inductance between the input/output external electrodes 10 and 11 in stages without disturbing the balance between the inductance of the input/output external electrode 10 and the tap center electrode 12 and the inductance between the input/output external electrode 11 and the tap center electrode 12.

Since the variable inductor device 20 contains the two coils 2 and 3 inside, it is not necessary to electrically connect the coils 2 and 3 by using circuit patterns, thereby decreasing the area required for mounting the inductor device 20 on a printed circuit board. For example, the variable inductor device 20 of an example of the first preferred embodiment preferably has a length of about 3.2 mm, a width of about 1.6 mm, and a height of about 0.5 mm.

Figure 8A:
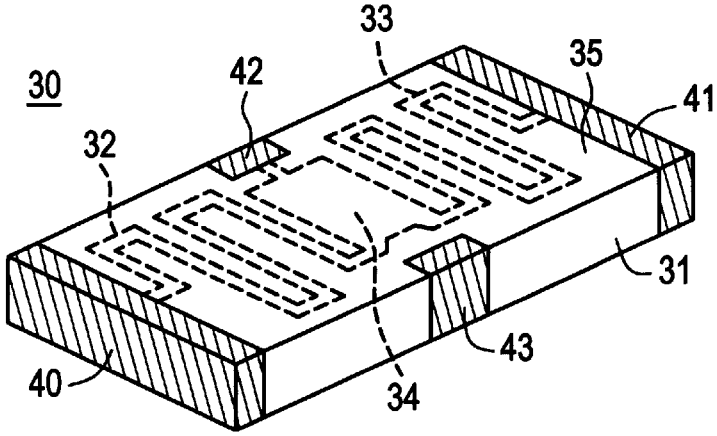
FIG. 8A is a perspective view illustrating a variable inductor device according to a second preferred embodiment of the present invention.

In a second preferred embodiment, coils 32 and 33 having a meandering arrangement and an inductance adjusting element 34 are disposed, as shown in FIG. 8A, on the upper surface of an insulating substrate 31 according to a thin-film forming method, such as a photolithographic technique. A variable inductor device 30 is thus formed. The inductance adjusting element 34 includes a substantially rectangular solid electrode and is disposed substantially at the approximate center of the insulating substrate 31. The inductance adjusting element 34 is electrically connected at one end (the distal end) to a tap center electrode 42 provided substantially at the approximate center of the distal lateral surface of the insulating substrate 31.

The meandering coils 32 and 33 preferably having the same dimensions are located, as shown in FIG. 8A, at the left and right sides of the insulating substrate 31 with the inductance adjusting element 34 disposed therebetween. The coil 32 is electrically connected at one end (the outer end) to an input/output external electrode 40 provided over the left lateral surface of the insulating substrate 31, while the coil 33 is electrically connected at one end (the outer end) to an input/output external electrode 41 provided over the right lateral surface of the substrate 1. The coils 32 and 33 are respectively electrically connected at the other ends (the inner ends) to the proximal ends of the inductance adjusting element 34. The inductance adjusting element 34 is axially symmetrical, and the coils 32 and 33 are arranged symmetrically relative to each other with respect to the axis of the inductance adjusting element 34. The inductances of the coils 32 and 33 are set to be substantially equal to each other. The coils 32 and 33 and the inductance adjusting element 34 are covered with an insulating protective film 35 formed on the upper surface of the insulating substrate 31. In FIG. 8A, there is shown a reinforcing dummy electrode 43 provided for soldering.

The operation and advantages achieved by the variable inductor device 30 are similar to those achieved by the variable inductor device 20 of the first preferred embodiment. Additionally, since the inductance adjusting element 34 is formed of a solid electrode, it can be trimmed as desired, not successively in stages. More specifically, the variable inductor device 30 is grooved and the inductance adjusting element 34 is partially removed by means such as applying a laser beam to the upper surface of the inductor device 30. Thus, the inductance between the input/output external electrodes 40 and 41 can be easily and accurately adjusted. During this operation, the amount by which the inductance adjusting element 34 (the solid electrode) is removed can be sequentially changed, thereby sequentially varying the inductance between the input/output external electrodes 40 and 41. Moreover, since the coils 32 and 33 have a meandering arrangement in the second preferred embodiment, the relay electrodes 6 and 7, which are required in the first preferred embodiment, are made unnecessary, thereby simplifying the manufacturing process.

Figure 8B:
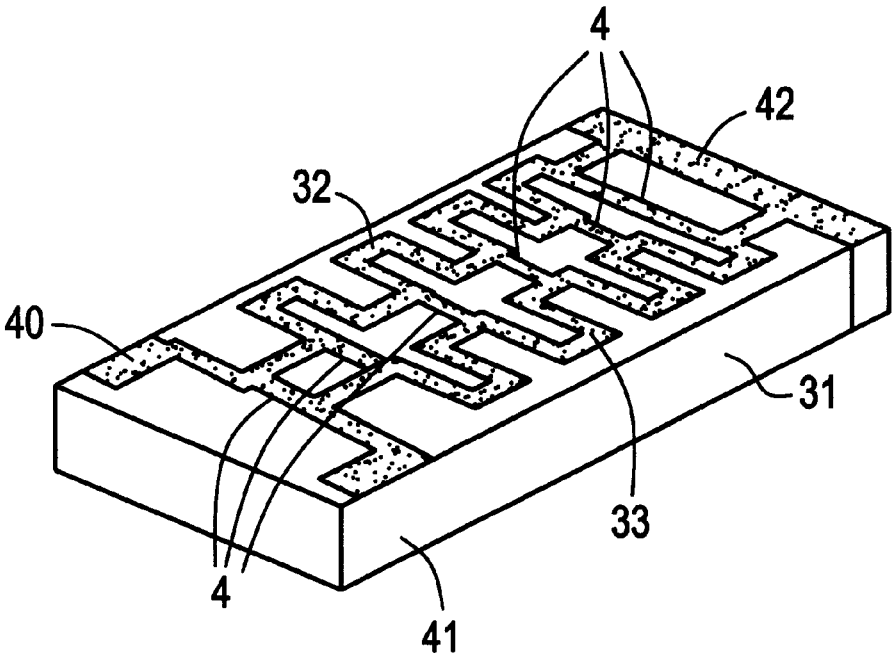
FIG. 8B is a perspective view illustrating a variable inductor device according to a modified example of the second preferred embodiment of the present invention.

FIG. 8B shows a modified example of the second preferred embodiment of the present invention. As shown in FIG. 8B, coils 32 and 33 having a meandering configuration and an inductance adjusting element 4 including a ladder electrode are disposed on an insulating substrate 31. In FIG. 8B, numerals 40 and 41 are input/output external electrodes and the numeral 42 is a tap center electrode. According to this preferred embodiment, since the inductance adjusting element 4 comprises a ladder electrode, the inductance unbalance of two coils 32 and 33 by trimming can be further reduced compared to the preferred embodiment of FIG. 8A where the inductance adjusting element 4 is formed of a solid electrode.

Figure 8C:
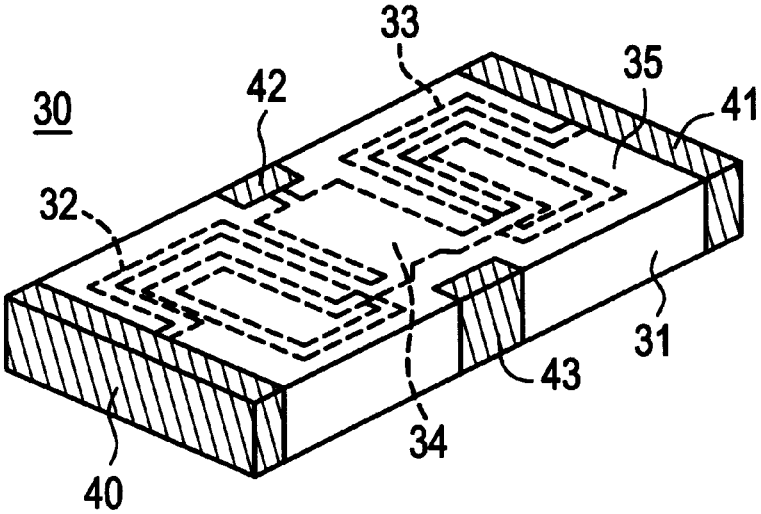
FIG. 8C is a perspective view illustrating a variable inductor device according to a further modified example of the second preferred embodiment of the present invention.

FIG. 8C shows another modified example of the second preferred embodiment of the present invention. Although meander-shaped coils 32, 33 are provided in the preferred embodiment of FIG. 8A, spiral coils 32', 33' can be provided as shown in FIG. 8C.

Figure 9:
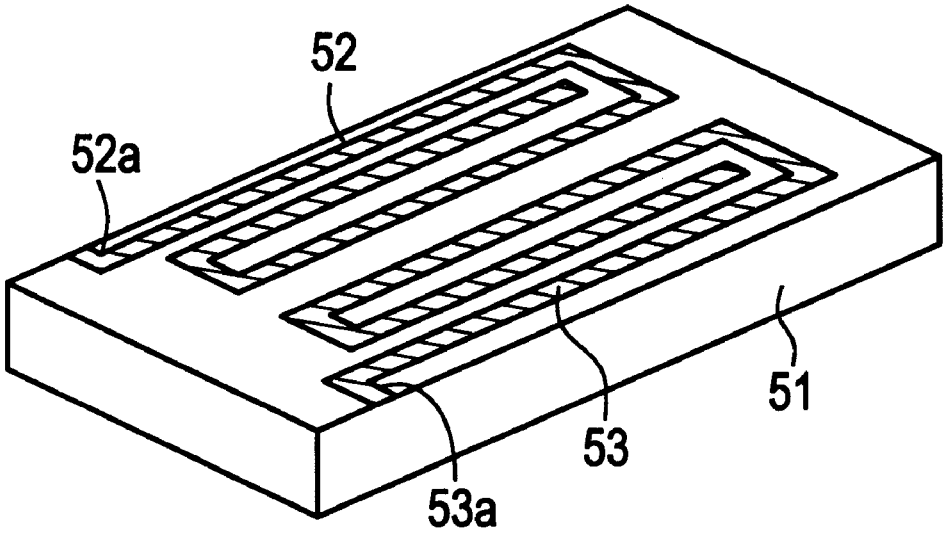
FIG. 9 is a perspective view illustrating a variable inductor device according to a third preferred embodiment of the present invention.

In a third preferred embodiment, spiral coils 52 and 53 having the same dimensions are formed, as shown in FIG. 9, on the upper surface of an insulating substrate 51 via a thick-film printing method or a thin-film forming method, such as a photolithographic technique. One coil 52 is located at the distal side of the insulating substrate 51, and one end (the outer end) 52*a* of the coil 52 is extended to the leftward distal side of the insulating substrate 51. The other coil 53 is located at the proximal side of the insulating substrate 51, and one end (the outer end) 53*a* of the coil 53 is extended to the leftward proximal side of the substrate 51.

Figure 10:
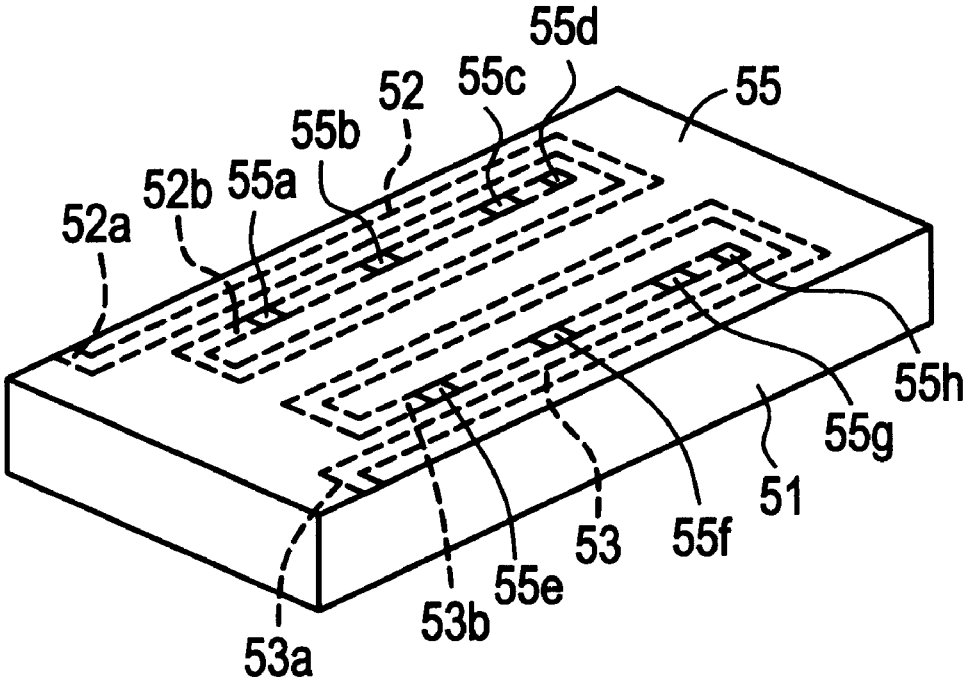
FIG. 10 is a perspective view illustrating the manufacturing step of the variable inductor device subsequent to the step shown in FIG. 9.

Then, an insulating protective film 55 having openings 55*a* through 55*h* is formed, as shown in FIG. 10, on the upper surface of the insulating substrate 51 via a thin-film forming method, such as a photolithographic technique. The inner portion 52*b* of the coil 52 is partially exposed through the openings 55*a* through 55*d*, while the inner portion 53*b* of the coil 53 is partially exposed through the openings 55*e*–55*h*.

Figure 11:
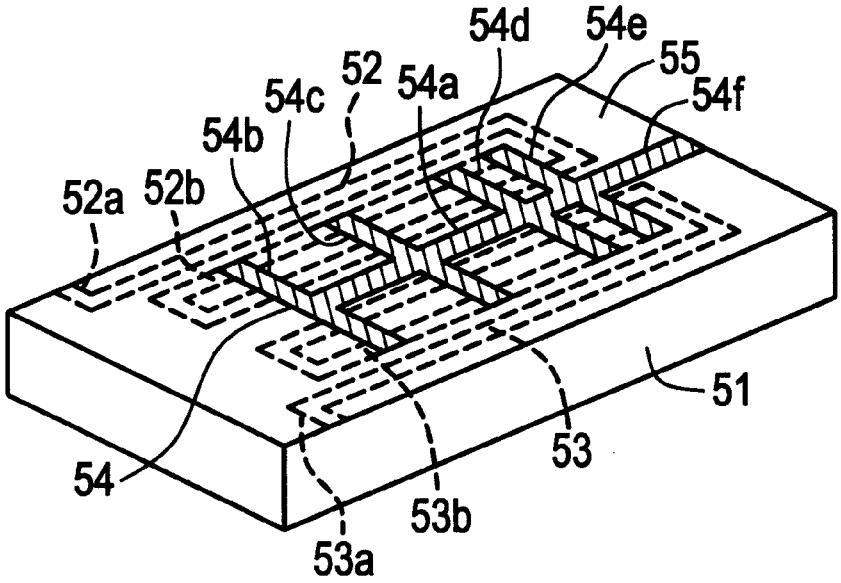
FIG. 11 is a perspective view illustrating the manufacturing step of the variable inductor device subsequent to the step shown in FIG. 10.

Subsequently, an inductance adjusting element 54 is formed, as illustrated in FIG. 11, via a thick-film printing method or a thin-film forming method, such as a photolithographic technique. The inductance adjusting element 54 includes a ladder electrode having a vertical path 54*a* at the approximate center of the adjusting element 54 and horizontal paths 54*b* through 54*e* which are substantially perpendicular to the vertical path 54*a*. The inductance adjusting element 54 is disposed substantially at the approximate center of the insulating substrate 51, and the horizontal paths 54*b* through 54*e* are overlapped with the areas surrounded by the respective spiral coils 52 and 53.

One end 54*f* of the inductance adjusting element 54 is extended to the right side of the insulating substrate 51, as viewed in FIG. 11. The horizontal path 54*b* electrically connects a predetermined area of the inner portion 52*b* of the coil 52 to a predetermined area of the inner portion 53*b* of the coil 53 via the openings 55*a* and 55*e* formed in the insulating protective film 55. Similarly, the horizontal paths 54*c* through 54*e* electrically connect predetermined areas of the inner portion 52*b* of the coil 52 to predetermined areas of the inner portion 53*b* of the coil 53 via the openings 55*b* through 55*d* and the openings 55*f* through 55*h*, respectively. The inductance adjusting element 54 is preferably axially symmetrical, and the coils 52 and 53 are positioned symmetrically relative to each other with respect to the axis of the inductance adjusting element 54. The inductances of the coils 52 and 53 are set to be substantially equal to each other.

Figure 12:
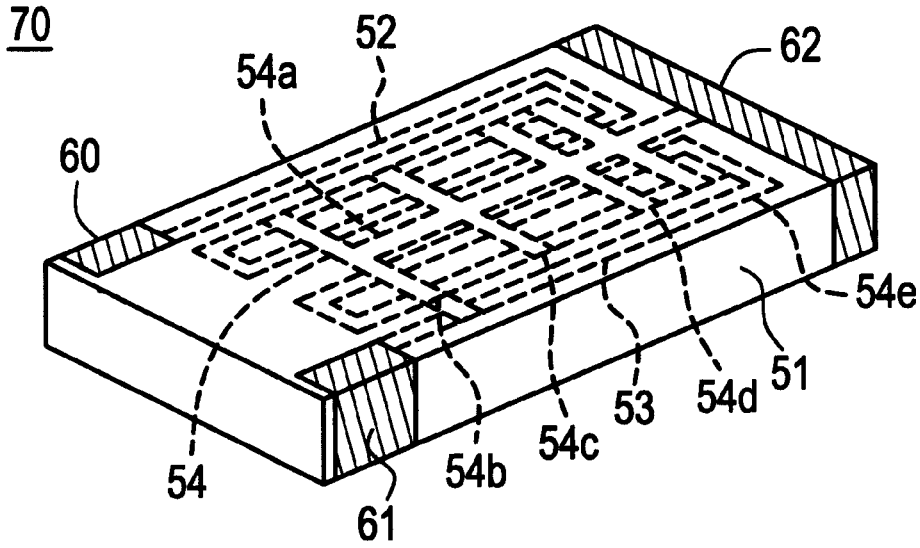
FIG. 12 is a perspective view illustrating the manufacturing step of the variable inductor device subsequent to the step shown in FIG. 11.

A liquid insulating material is then applied, as shown in FIG. 12, to the overall upper surface of the insulating substrate 51 via spin-coating or printing, and dried, thereby forming the insulating protective film 55 covering the inductance adjusting element 54. Thereafter, input/output external electrodes 60 and 61 are respectively provided on the leftward distal lateral surface and the leftward proximal lateral surface of the insulating substrate 51. The input/output external electrode 60 is electrically connected to the outer end 52*a* of the coil 52, while the input/output external electrode 61 is electrically connected to the outer end 53*a* of the coil 53. Further, a tap center electrode 62 is provided over the right lateral surface of the insulating substrate 51 and is electrically connected to the end 54*f* of the inductance adjusting element 54.

Figure 13:
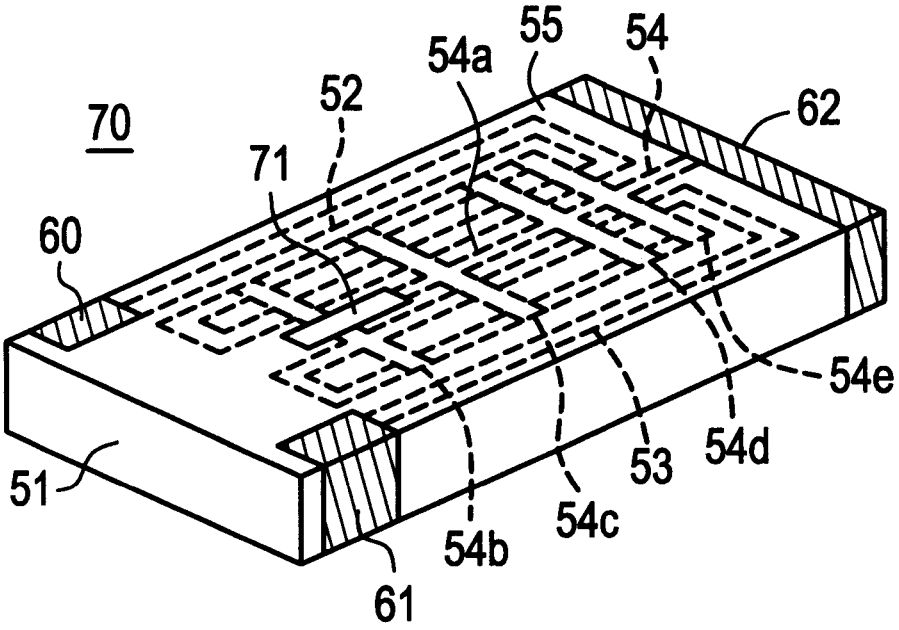
FIG. 13 is a perspective view illustrating the inductance adjusting method of the variable inductor device shown in FIG. 12.

A variable inductor device 70 is thus formed according to the foregoing procedure. The circuitry of the inductor device 70 is configured in such a manner that the two coils 52 and 53 are electrically connected to each other on the insulating substrate 51 via the intervening inductance adjusting element 54 which is partially overlapped with the coils 52 and 53. After the variable inductor device 70 is mounted on a printed circuit board, the inductance adjusting element 54 is trimmed. More specifically, a groove 71 is formed in the vertical path 54*a* of the inductance adjusting element 54 and the horizontal paths 54*b* through 54*e* of the inductance adjusting element 54 are disconnected one by one by means such as applying a pulsating laser beam to the upper surface of the variable inductor device 70 (FIG. 13 shows that the horizontal path 54*b* has been disconnected). It is thus possible to vary in stages the inductance between each of the input/output external electrodes 60 and 61 and the tap center electrode 62 and the inductance between the input/output external electrodes 60 and 61.

The ratio of the inductance of the coil 52 to the inductance of the coil 53 (in other words, the ratio of the inductance between the input/output external electrode 60 and the tap center electrode 62 to the inductance between the input/output external electrode 61 and the tap center electrode 62) is constant even though the inductance adjusting element 54 is trimmed. This is because the inductances of the coils 52 and 53 are equal to each other since the coils 52 and 53 are symmetrically positioned with respect to the inductance adjusting element 54. Additionally, the inductance adjusting element 54 is electrically connected to the two coils 52 and 53 in an equivalent manner. Accordingly, when the horizontal paths 54*b* through 54*d* of the inductance adjusting element 54 are sequentially disconnected, the inductances of the coils 52 and 53 are equally changed.

In this manner, according to the variable inductor device 70, the ratio of the inductance of the coil 52 to the inductance of the coil 53 is set to be constant even though the inductance adjusting element 54 is trimmed. Thus, if the inductances of the two coils 52 and 53 are initially different, the positions at which the respective coils 52 and 53 are connected to the inductance adjusting element 54 should be correspondingly different. In such a case, the following modification is required to set the inductances of the coils 52 and 53 to be constant. The horizontal paths 54*b* through 54*d* of the inductance adjusting element 54 are designed to be asymmetrical with respect to the horizontal path 54*a*. Thus, a change in the inductance of the coil 52 is differentiated from that of the coil 53 when the horizontal paths 54*b* through 54*d* are sequentially disconnected.

In this manner, the horizontal paths 54*b* through 54*d* of the inductance adjusting element 54 have been arranged in such a manner that the inductances of the coils 52 and 53 are changed via given pitches. It is thus possible to obtain a variable inductor device 70 which is able to adjust in stages the inductance between the input/output external electrodes 60 and 61 without disturbing the balance between the inductance between the input/output external electrode 60 and the tap center electrode 62 and the inductance between the input/output external electrode 61 and the tap center electrode 62.

Figure 14:
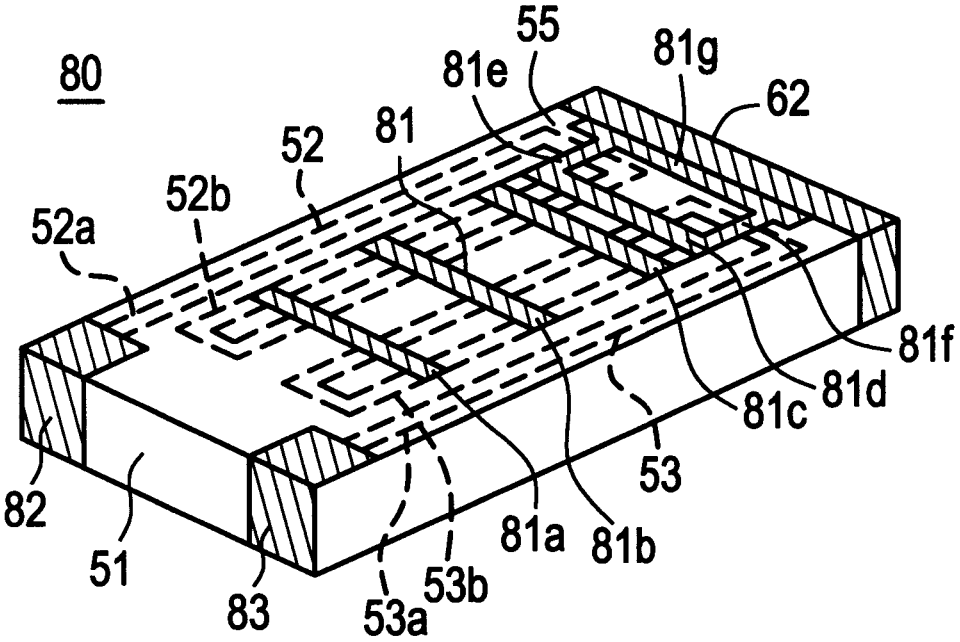
FIG. 14 is a perspective view illustrating a variable inductor device according to a fourth preferred embodiment of the present invention.

In a fourth preferred embodiment, a variable inductor device 80 shown in FIG. 14 is similar to the inductor device 70 of the third preferred embodiment illustrated in FIG. 12, except for an inductance adjusting element 81 and input/output external electrodes 82 and 83. It should be noted that the inductance adjusting element 81 is not covered with an insulating protective film 55. The inductance adjusting element 81 is substantially equivalent to the inductance adjusting element 54 of the third preferred embodiment which is free of a vertical path 54*a*, and is formed of a ladder electrode having four horizontal paths 81*a* through 81*d*. Connecting portions 81*e* and 81*f* extending from both ends of the horizontal path 81*d* are electrically connected, as shown in FIG. 14, to the tap center electrode 62 via a common leading portion 81*g*, though they may be directly connected thereto. The horizontal paths 81*a* through 81*d* electrically connect predetermined areas of the inner portion 52*b* of the coil 52 to predetermined areas of the inner portion 53*b* of the coil 53 via openings 55*a* through 55*d* and openings 55*f* through 55*h* (FIG. 10), respectively, formed in the insulating protective film 55.

The input/output external electrodes 82 and 83 are respectively provided on the leftward distal end and the leftward proximal end of the insulating substrate 51. This makes it possible to make the distance between the input/output external electrodes 82 and 83 even smaller than that of the input/output external electrodes 60 and 61 of the third preferred embodiment.

After the variable inductor device 80 is mounted on a printed circuit board, the inductance adjusting element 81 is trimmed. More specifically, the variable inductor device 80 is grooved and the horizontal paths 81*a* through 81*d* of the inductance adjusting element 81 are sequentially disconnected one by one by means such as applying a pulsating laser beam to the upper surface of the variable inductor device 80. It is thus possible to vary the inductance between the input/output external electrodes 82 and 83 in stages without changing the inductance between each of the input/output external electrodes 82 and 83 and the tap center electrode 62. Accordingly, the horizontal paths 81*a* through 81*d* of the inductance adjusting element 81 have been located in such a manner that the inductance between the input/output external electrodes 82 and 83 is variable via given pitches. It is thus possible to obtain a variable inductor device 80 which is capable of adjusting the inductance between the input/output external electrodes 82 and 83 in stages without disturbing the balance between the inductance between the inpu/output external electrode 82 and the tap center electrode 62 and the inductance between the input/output external electrode 83 and the tap center electrode 62.

Figure 15:
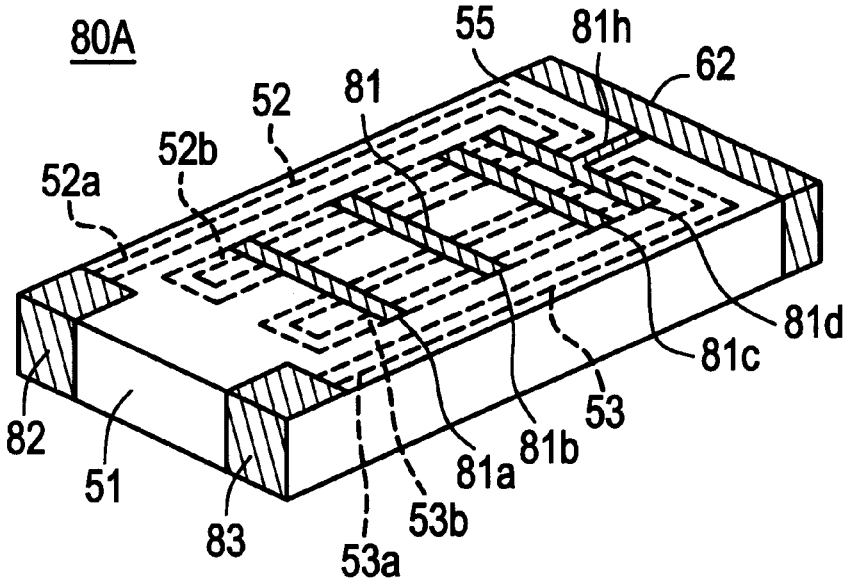
FIG. 15 is a perspective view illustrating an example of modifications made to the variable inductor device shown in FIG. 14.

The inductance adjusting element 81 may be connected to the tap center electrode 62, as illustrated in FIG. 15, via a leading portion 81*h* extending from the approximate central portion of the horizontal path 81*d*. A greater level of inductance is obtained, however, for the coils 52 and 53, if the inductance adjusting element 81 is connected at its end portions to the tap center electrode 62, as shown in FIG. 14. The variable inductor device 80A shown in FIG. 15 is mounted on a printed circuit board, and then, the inductance adjusting element 81 is trimmed. More specifically, the variable inductor device 80A is grooved and the horizontal paths 81*a* through 81*c* of the inductance adjusting element 81 are sequentially disconnected one by one by means such as applying a pulsating laser beam to the upper surface of the variable inductor device 80A. As a consequence, the inductance between the input/output external electrodes 82 and 83 can be varied in stages without changing the inductance between each of the input/output external electrodes 82 and 83 and the tap center electrode 62.

Figure 16:
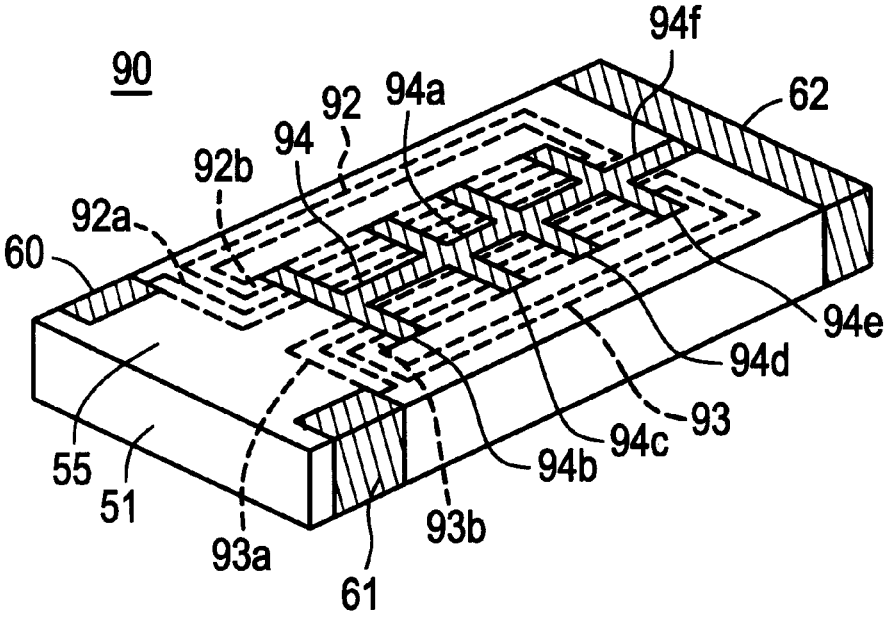
FIG. 16 is a perspective view illustrating a variable inductor device according to a fifth preferred embodiment of the present invention.

In a fifth preferred embodiment, a variable inductor device 90 illustrated in FIG. 16 is similar to the variable inductor device 70 of the third preferred embodiment shown in FIG. 12, except for spiral coils 92 and 93 and an inductance adjusting element 94. The spiral coils 92 and 93 preferably having the same dimensions are electrically connected at their outer ends 92*a* and 93*a* to input/output external electrodes 60 and 61, respectively. Further, the coil 92 is configured in such a manner that the terminating portion 92*b* viewed from the input/output external electrode 60 is positioned near the coil 93. Similarly, the coil 93 is configured in such a manner that the terminating portion 93*b* viewed from the input/output external electrode 61 is located in the vicinity of the coil 92. The number of windings of each of the coils 92 and 93 is preferably 1.5 turns or more, and more specifically, (1.5+n) turns, where n is an integer (0, 1, 2 . . . ). With this arrangement, the inductance adjusting element 94 is not overlapped with the areas surrounded by the respective spiral coils 92 and 93.

The inductance adjusting element 94 preferably includes a ladder electrode having a vertical path 94*a* positioned at the approximate center of the inductance adjusting element 94 and horizontal paths 94*b* through 94*e* arranged substantially perpendicular to the vertical path 94*a*. The inductance adjusting element 94 is positioned substantially at the center of the insulating substrate 51 and is electrically connected at one end 94*f* to a tap center electrode 62. The horizontal paths 94*b* through 94*e* electrically connect predetermined areas of the inner portion 92*b* of the coil 92 to predetermined areas of the inner portion 93*b* of the coil 93 via openings (not shown) formed in the insulating protective film 55.

The operation and advantages achieved by the variable inductor device 90 are similar to those achieved by the variable inductor device 70 of the third preferred embodiment. Additionally, since the inductance adjusting element 94 is not overlapped with the areas surrounded by the respective coils 92 and 93, the magnetic flux passing through the above areas is not interrupted by the inductance element portion 94, thereby producing a high level of Q factor.

Figure 17:
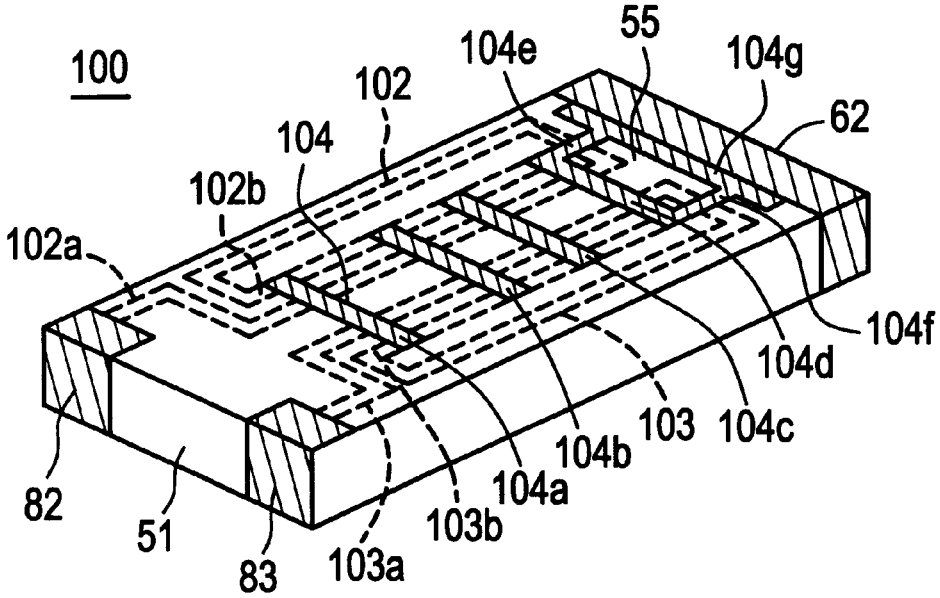
FIG. 17 is a perspective view illustrating a variable inductor device according to a sixth preferred embodiment of the present invention.

A sixth preferred embodiment provides a variable inductor device 100 shown in FIG. 17 which is similar to the variable inductor device 80 of the fourth preferred embodiment illustrated in FIG. 14, except for spiral coils 102 and 103 and an inductance adjusting element 104.

The coil 102 is arranged in such a manner that a terminating portion 102*b* viewed from an input/output external electrode 82 is positioned near the coil 103. Likewise, the coil 103 is arranged in such a manner that a terminating portion 103*b* viewed from an input/output external electrode 83 is located in the vicinity of the coil 102. The number of windings of each of the coils 102 and 103 is preferably 1.5 turns or more, and more specifically, (1.5+n) turns where n indicates an integer (0, 1, 2 . . . ). With this configuration, the inductance adjusting element 104 is not overlapped with the areas surrounded by the respective coils 102 and 103. The spiral coils 102 and 103 are electrically connected at their inner ends 102*a* and 103*a* to the input/output external electrodes 82 and 83, respectively.

The inductance adjusting element 104 preferably includes a ladder electrode preferably having four horizontal paths 104*a* through 104*d*. The inductance adjusting element 104 is located substantially at the center of the insulating substrate 51, and is electrically connected to a tap center electrode 62 via connecting portions 104*e* and 104*f* extending from both ends of the horizontal path 104*d*. The horizontal paths 104*a* through 104*d* electrically connect predetermined areas of the inner portion 102 of the coil 102 to predetermined areas of the inner portion 103*b* of the coil 103 via openings (not shown) formed in the insulating protective film 55.

The operation and advantages achieved by the variable inductor device 100 are similar to those achieved by the variable inductor device 80 of the fourth preferred embodiment. Further, since the inductance adjusting element 104 is not overlapped with the areas surrounded by the respective spiral coils 102 and 103, the magnetic flux passing through the above areas can be free from an influence of the inductance adjusting element 104, thereby achieving a high level of Q factor.

Figure 18:
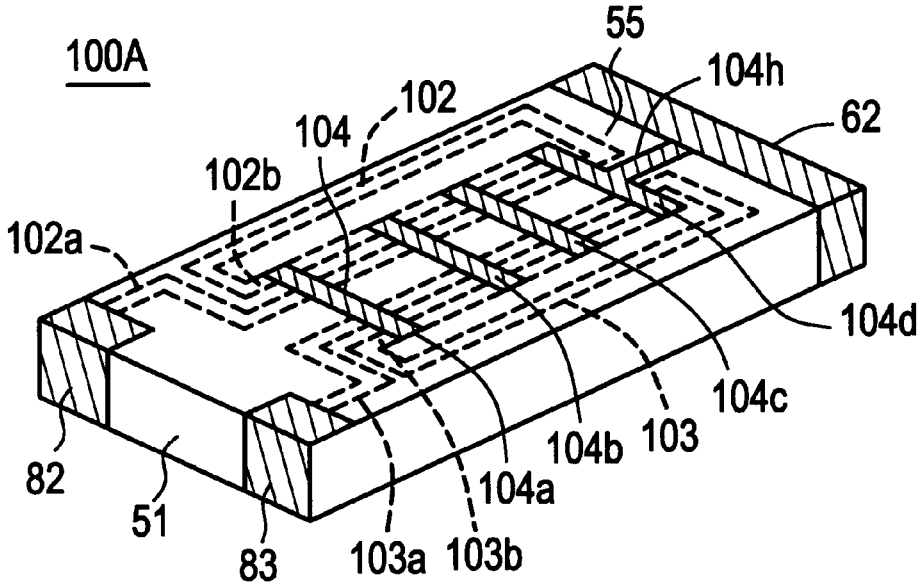
FIG. 18 is a perspective view illustrating an example of modifications made to the variable inductor device shown in FIG. 17.

The variable inductor device 100 may be modified to a variable inductor device 100A, as illustrated in FIG. 18, in which the inductance adjusting element 104 may be electrically connected to the tap center electrode 62 via a leading portion 104*h* extending from an approximate center of the horizontal path 104*d*. A greater level of inductance, however, may be achieved for the coils 102 and 103 if the horizontal path 104*d* is connected to the tap center electrode 62 via the connecting portions 104*e* and 104*f*.

A laminated variable inductor device according to a seventh preferred embodiment of the present invention will now be explained.

A laminated variable inductor device 111 includes an insulating sheet 112 on which an inductance adjusting element 125 is disposed, insulating sheets 112 respectively provided with coil conductors 113, 114, 115 and 116, a protective insulating sheet 112, and an insulating sheet 112 used as an intermediate layer. Each insulating sheet 112 may be formed by a ceramic green sheet.

A leading portion 114*a* of the coil conductor 114 is extended to the left side of the associated insulating sheet 112, while a leading portion 116*a* of the coil conductor 116 is extended to the right side of the associated insulating sheet 112. The coil conductors 113 and 114 are electrically connected to each other through a via hole 130*b* provided in the associated sheet 112, thereby forming a helical (solenoid) coil 121. Similarly, the coil conductors 115 and 116 are electrically connected to each other through a via hole 131*d* provided in the associated sheet 112, thereby forming a helical coil 122.

The inductance adjusting element 125 includes a ladder electrode having a substantially U-shaped frame portion 125*a* and a plurality of horizontal paths 125*b* bridging two arms of the frame portion 125*a*. One end (the proximal end) 125*c* of the inductance adjusting element 125 is extended to the proximal side of the insulating sheet 112. The left distal end 125*d* opposite to the proximal end 125*c* of the inductance adjusting element 125 is electrically connected to one end of the coil 121 (more specifically, one end of the coil conductor 113) through a via hole 130*a* provided in the associated sheet 112. Likewise, the right distal end 125*e* opposite to the proximal end 125*c* is electrically connected to one end of the coil 122 (more specifically, one end of the coil conductor 115) through via holes 131*a*, 131*b* and 131*c* provided in the associated sheets 112. The inductance adjusting element 125 and the coil conductors 113 through 116 are disposed on the associated sheets 112 by using a conductive paste made from Ag, Ag-Pd, or Cu by means such as printing.

Figure 20:
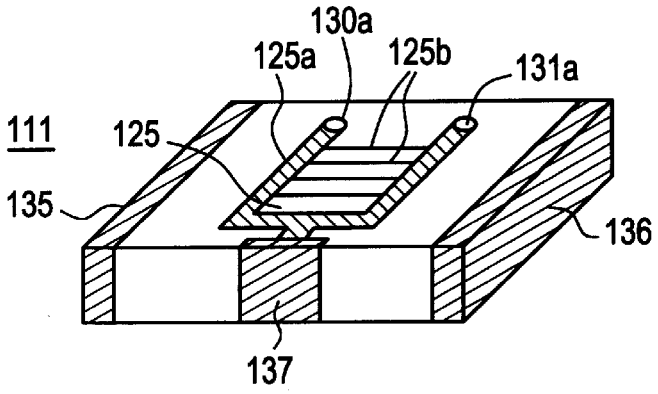
FIG. 20 is a perspective view illustrating the outer appearance of the variable inductor device shown in FIG. 19.

The insulating sheets 112 are laminated and integrally baked to form a laminated structure, as illustrated in FIG. 20. An extra protective insulating sheet 112 may be laminated on the surface of the inductance adjusting element 125, if necessary. Subsequently, as shown in FIG. 20, input/output external electrodes 135 and 136 are provided over the left and right lateral surfaces of the laminated structure, and a tap center electrode 137 is disposed on the proximal lateral surface of the laminated structure. The input/output external electrode 135 is electrically connected to the leading portion 114*a* of the coil conductor 114, while the input/output external electrode 136 is electrically connected to the leading portion 116*a* of the coil conductor 116. The tap center electrode 137 is electrically connected to the proximal end 125*c* of the inductance adjusting element 125. These electrodes 135, 136 and 137 are formed by applying a conductive paste made from Ag or Ag-Pd and by being burned or dry-plating Ni-Cr or a Cu alloy.

The laminated variable inductor device 111 is thus formed by the foregoing procedure. The circuitry of the inductor device 111 is configured in such a manner that the two coils 121 and 122 are electrically connected to each other via the inductance adjusting element 125. The operation and advantages achieved by the laminated variable inductor device 111 are similar to those achieved by the variable inductor device 20 of the first preferred embodiment. Moreover, the variable inductor device 111 is a laminated structure of the coils 121 and 122 and the inductance adjusting element 125, thereby decreasing the area required for mounting the device 111 on a printed circuit board.

Another laminated variable inductor device according to an eighth preferred embodiment of the present invention will now be described.

Figure 21:
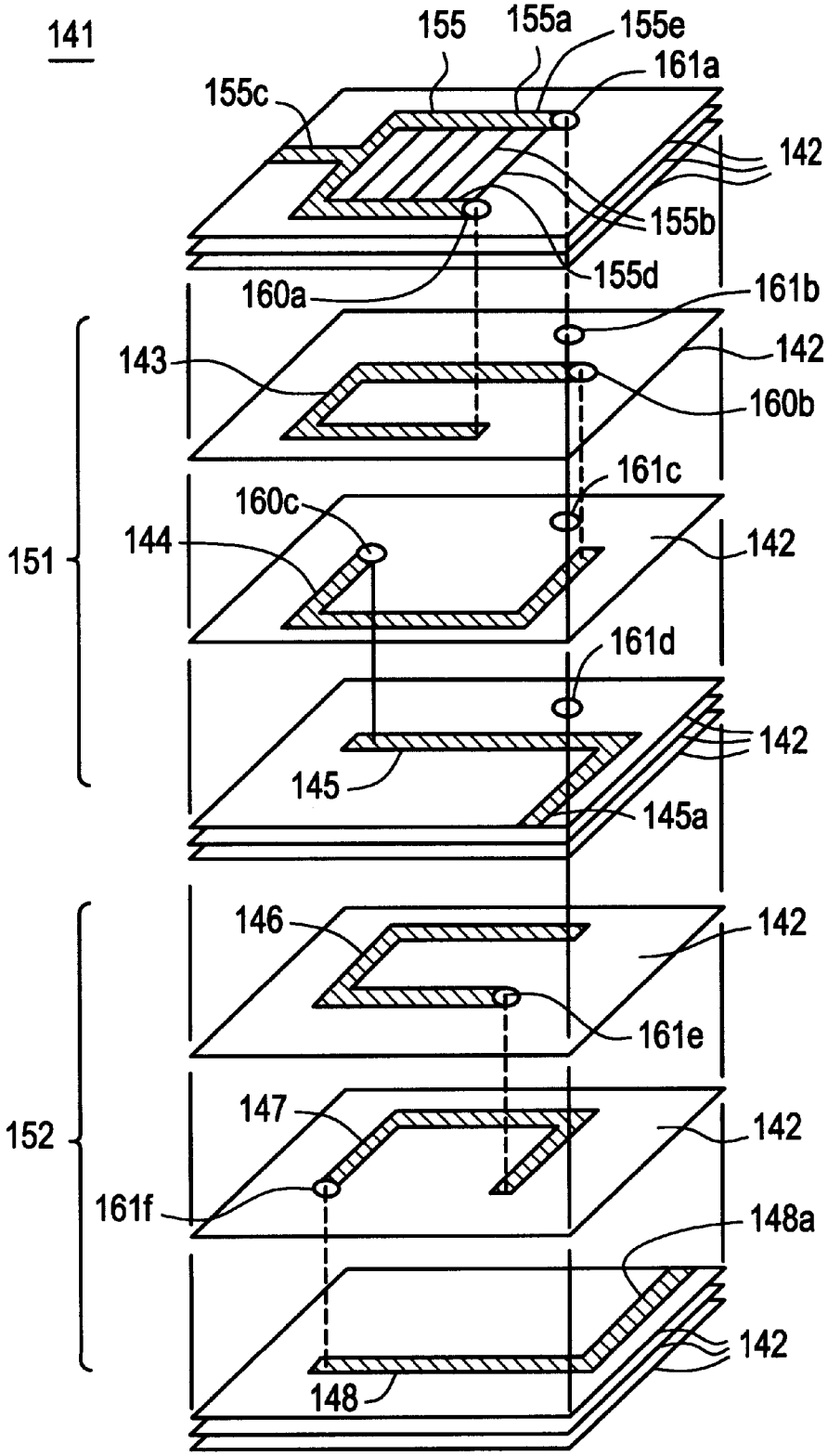
FIG. 21 is an exploded perspective view illustrating a laminated variable inductor device according to an eighth preferred embodiment of the present invention.

A laminated variable inductor device 141 is formed of, as shown in FIG. 21, an insulating sheet 142 on which an inductance adjusting element 155 is disposed, insulating sheets 142 respectively provided with coil conductors 143 through 148, a protective insulating sheet 142, and an insulating sheet 142 used as an intermediate layer.

A leading portion 145*a* of the coil conductor 145 is extended to the rightward proximal side of the associated insulating sheet 142, while a leading portion 148*a* of the coil conductor 148 is extended to the rightward distal side of the associated insulating sheet 142. The coil conductors 143 through 145 are electrically connected to each other through via holes 160*b* and 160*c* provided in the associated sheets 142, thereby forming a helical coil 151. Likewise, the coil conductors 146 through 148 are electrically connected through via holes 161*e* and 161*f* provided in the associated sheets 142, thereby forming a helical coil 152.

The inductance adjusting element 155 preferably includes a ladder electrode having a substantially U-shaped frame portion 155*a* and a plurality of horizontal paths 155*b* bridging two arms of the frame portion 155*a*. One end (the left end) 155*c* of the inductance adjusting element 155 is extended to the left side of the associated sheet 142. The right proximal end 155*d* opposite to the left end 155*c* of the inductance adjusting element 155 is electrically connected to one end of the coil 151 (more specifically, one end of the coil conductor 143) through a via hole 160*a* provided in the associated sheet 142. Similarly, the right distal end 155*e* opposite to the left end 155*c* of the inductance adjusting element 155 is electrically connected to one end of the coil 152 (more specifically, one end of the coil conductor 146) through the via holes 160*a* through 161*d* provided in the associated sheets 142.

Figure 22:
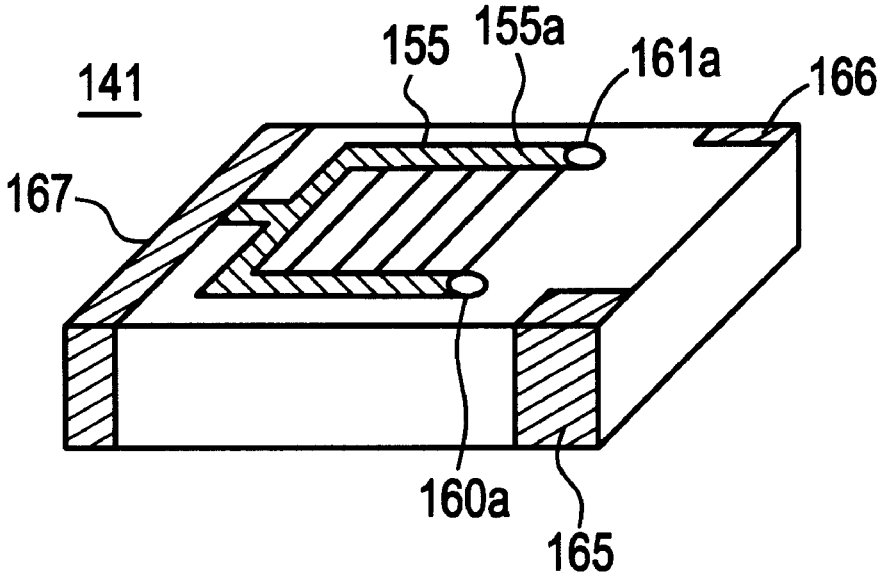
FIG. 22 is a perspective view illustrating the outer appearance of the variable inductor device shown in FIG. 21.

The insulating sheets 142 are laminated and integrally baked to form a laminated structure, as illustrated in FIG. 22. An extra protective insulating sheet may be laminated on the surface of the inductance adjusting element 155, if necessary. Thereafter, input/output external electrodes 165 and 166 are respectively provided on the rightward proximal and distal surfaces of the laminated structure. A tap center electrode 167 is further disposed over the left lateral surface of the laminated structure. The input/output external electrode 165 is electrically connected to the leading portion 145*a* of the coil conductor 145, while the input/output external electrode 166 is electrically connected to the leading portion 148*a* of the coil conductor 148. The tap center electrode 167 is electrically connected to the left end 155*c* of the inductance adjusting element 155.

A laminated variable inductor device 141 is thus obtained by the foregoing procedure. The operation and advantages achieved by the inductor device 141 are similar to those achieved by the laminated variable inductor device 111 of the seventh preferred embodiment.

The variable inductor device is not restricted to the foregoing preferred embodiments, and may be variously changed and modified within the spirit and scope of the appended claims.

The foregoing preferred embodiments have been explained for a case in which variable inductor devices are individually manufactured. For mass production, it is effective that a plurality of variable inductor devices are mounted on a motherboard (wafer), which is then cut into pieces according to the required size in the final manufacturing process by means of dicing or scribe-breaking.

In the seventh and eighth preferred embodiments, the laminated variable inductor devices are manufactured by laminating insulating sheets provided with conductive patterns and by integrally baking the sheets. However, the present invention is not limited to the above sheet-processing technique. Pre-baked insulating sheets may be used to manufacture the laminated variable inductor devices.

Alternatively, a laminated variable inductor device may be manufactured by using the following printing technique. More specifically, after an insulating layer is formed by using a paste-like insulating material by means such as printing, a paste-like conductive material is applied to the surface of the insulating layer to form a certain pattern. Then, a paste-like insulating material is further applied to the pattern, thereby forming a pattern-containing insulating layer. The foregoing process is repeated to obtain a laminated variable inductor device.

Figure 23:
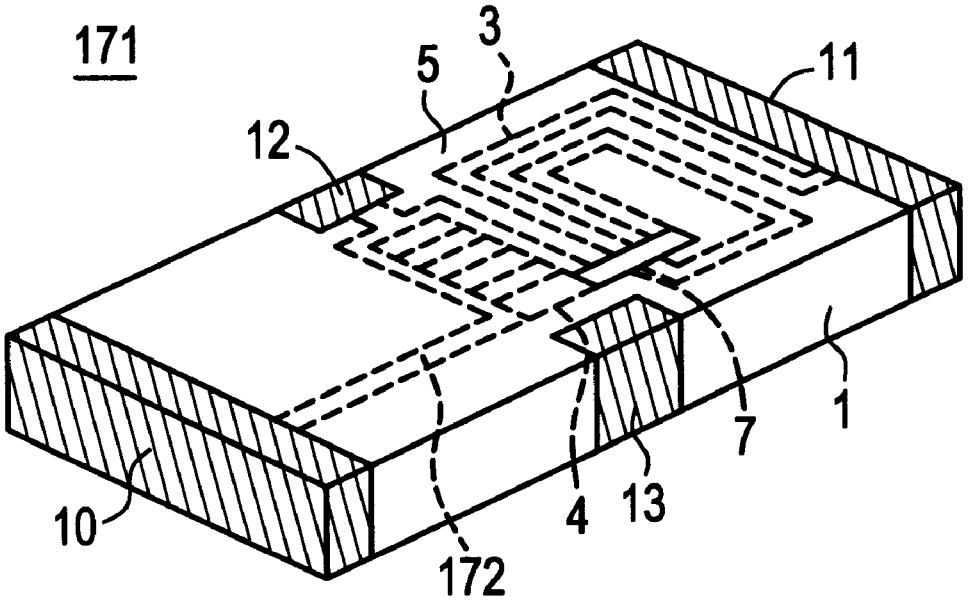
FIG. 23 is a perspective view illustrating a modification made to the variable inductor device shown in FIG. 6.

Moreover, the two coils used in the variable inductor device are not necessarily disposed symmetrically to each other with respect to the inductance adjusting element. For example, a linear coil 172 may be used, as shown in FIG. 23, in place of the spiral coil 2 of the variable conductor device 20 (FIG. 6). As a consequence, a variable inductor device 171 having the two coils 3 and 172 which have different shapes and different inductances may be formed.

Figure 24:
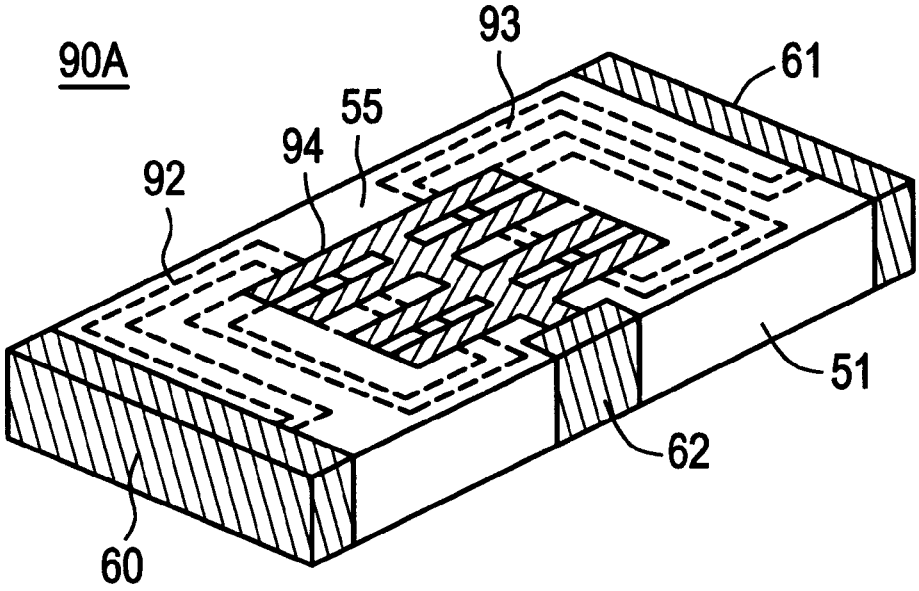
FIG. 24 is a perspective view illustrating a modification made to the variable inductor device shown in FIG. 16.
Figure 25:
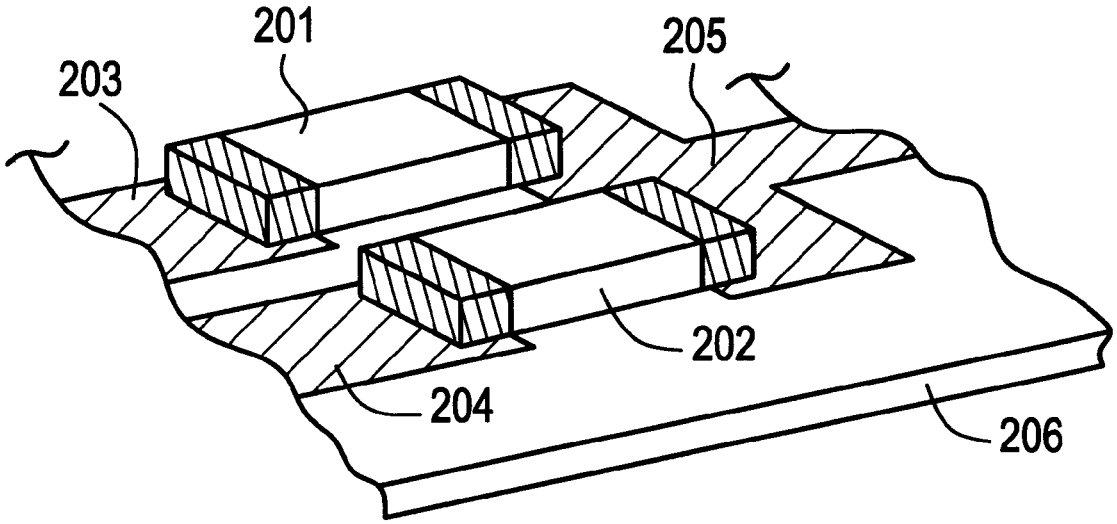
FIG. 25 is a perspective view illustrating a conventional variable inductor device.

In the variable inductor devices 70, 80, 90 and 100 of the respective third through sixth preferred embodiments, the input/output external electrodes are each provided on one lateral surface on a width side of the insulating substrate, while the tap center electrode is disposed over the other lateral surface on the width side of the insulating substrate. However, the above arrangement of the components is not essential. For example, the variable inductor device 90 of the fifth preferred embodiment illustrated in FIG. 16 may be modified to form a variable inductor device 90A shown in FIG. 24. More specifically, the input/output external electrodes 60 and 61 may be positioned over both lateral surfaces along the width of the insulating substrate 51, while the tap center electrode 62 may be located substantially at the center of a lateral surface of a length side of the insulating substrate 51. This modification makes it possible to form external electrodes without lowering the insulation-resistance properties therebetween even if the size of the device is reduced. In the modification shown in FIG. 24, an insulating layer may be formed on the inductance adjusting element 94.

Figure 19:
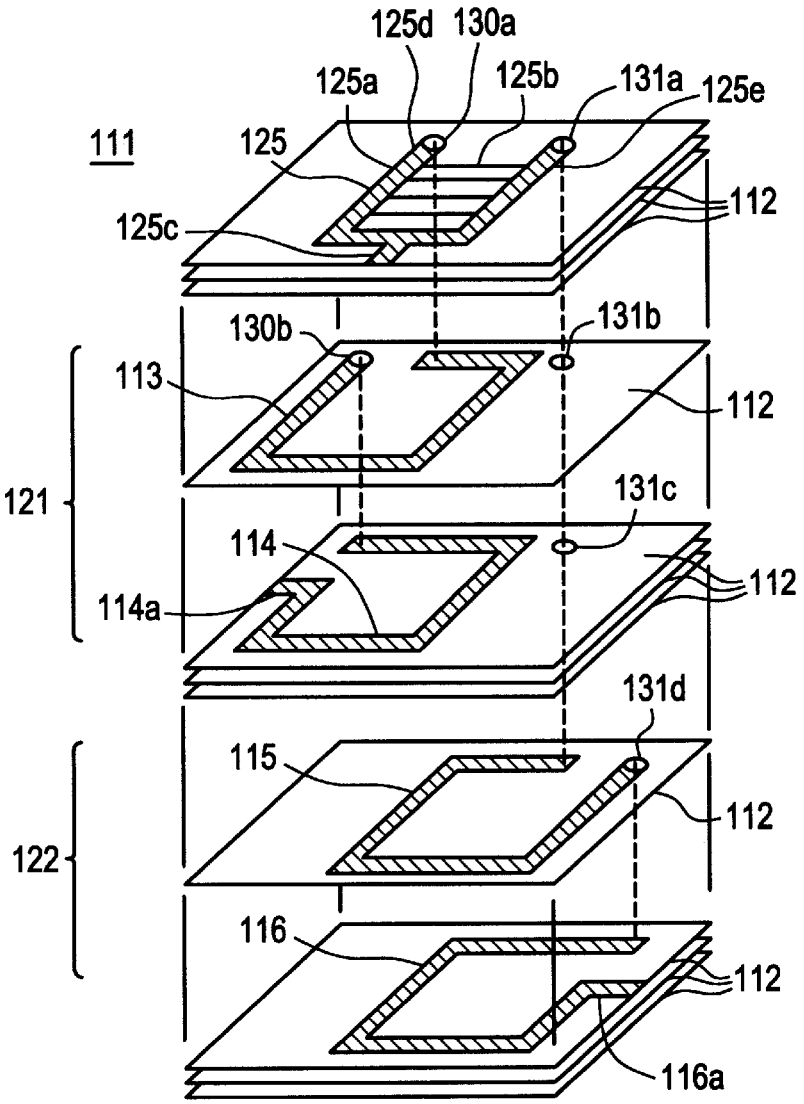
FIG. 19 is an exploded perspective view illustrating a laminated variable inductor device according to a seventh preferred embodiment of the present invention.

In the laminated variable inductor devices 111 and 141 of the seventh and eighth preferred embodiments, the coils 121 and 122 and the coils 151 and 152 respectively disposed on the different sheets are sequentially laminated in the orders shown in FIGS. 19 and 21, respectively. However, in the laminated variable inductor device 111, for example, the coil conductors 113 and 115 may be provided on the same sheet, while the coil conductors 114 and 116 may also be disposed on the same sheet, and the coils 121 and 122 may be arranged side by side when the sheets are laminated.

Further, the variable inductor device may have three or more coils, in which case, an inductance adjusting element should be provided between two adjacent coils, and one end of each of the inductance adjusting elements should be electrically connected to one tap center electrode.

Additionally, the coils have a meandering configuration only in the second preferred embodiment, while the coils are formed in a spiral shape in the other preferred embodiments. Either type of coil, however, may be used. Further, linear coils may be used, as in the modification illustrated in FIG. 23. It should be noted that the elements of the respective preferred embodiments may be suitably combined without departing from the spirit and scope of the appended claims.

As is seen from the foregoing preferred embodiments, the variable inductor device of the present invention offers the following advantages. At least two coils are electrically connected to each other via an inductance adjusting element. By trimming the inductance adjusting element, it is therefore possible to vary the inductance between the input/output external electrodes or the inductance between each of the input/output external electrodes and the tap center electrode without disturbing the balance between the inductances of the respective coils. Moreover, since the variable inductor device contains at least two coils, it is not necessary to electrically connect two coil components via circuit patterns disposed on a printed circuit board, thereby decreasing the area required for mounting the inductor device on the printed circuit board.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A variable inductor device comprising:

an insulating substrate;

at least a first coil and a second coil provided on or within said insulating substrate;

an inductance adjusting element provided on or within said insulating substrate and connecting a first end of said first coil to a first end of said second coil, said inductance adjusting element being arranged to be trimmed to adjust substantially only inductances of said first and second coils;

input/output external electrodes provided on or within said insulating substrate and electrically connected to second ends of said first and second coils, respectively; and a tap center electrode provided on or within said insulating substrate and electrically connected to one of said inductance adjusting element.

2. A variable inductor device according to claim 1, wherein said first and second coils and said inductance adjusting element are provided on an upper surface of said insulating substrate.

3. A variable inductor device according to claim 2, wherein said first and second coils and said inductance adjusting element comprise a thin-film material.

4. A variable inductor device according to claim 1, wherein said first and second coils and said inductance adjusting element are provided inside of said insulating substrate.

5. A variable inductor device according to claim 4, wherein said first and second coils and said inductance adjusting element are formed according to a sheet-processing technique or a printing technique.

6. A variable inductor device according to claim 1, wherein said first and second coils and said inductance adjusting element are arranged side by side on a common surface of said insulating substrate.

7. A variable inductor device according to claim 6, wherein said first and second coils are symmetrically positioned with respect to said inductance adjusting element.

8. A variable inductor device according to claim 6, wherein said first and second coils are disposed on a surface different from a surface on which said inductance adjusting element is disposed.

9. A variable inductor device according to claim 8, wherein said inductance adjusting element is disposed on an obverse surface of said insulating substrate and said first and second coils are disposed inside said insulating substrate.

10. A variable inductor device according to claim 1, wherein inductances of said first and second coils are substantially equal to each other.

11. A variable inductor device according to claim 1, wherein a shape of said first and second coils is spiral, helical, meandering, or linear.

12. A variable inductor device according to claim 1, wherein said inductance adjusting element comprises a ladder electrode or a solid electrode.

13. A variable inductor device according to claim 12, wherein said inductance adjusting element comprises a ladder electrode having a vertical path located substantially at an approximate center of said ladder electrode.

14. A variable inductor device according to claim 1, wherein said input/output external electrodes are provided on lateral surfaces on a width side of said insulating substrate and said tap center electrode is provided substantially at an approximate center of a lateral surface on a length side of said insulating substrate.

15. A variable inductor device according to claim 1, wherein said input/output external electrodes are each provided on one lateral surface on a width side of said insulating substrate and said tap center electrode is provided on the other lateral surface on the width side of said insulating substrate.

16. A variable inductor device according to claim 1, wherein a terminating end of said first coil viewed from a corresponding one of said input/output external electrodes is positioned near said second coil and a terminating end of said second coil viewed from the other input/output external electrode is positioned near said first coil.

17. A variable inductor device according to claim 1, wherein said first and second coils have a spiral shape having 1.5 or more turns of winding of each of said coils, and wherein a terminating end of said first coil viewed from a corresponding one of said input/output external electrodes is positioned near said second coil and a terminating end of said second coil viewed from the other input/output external electrode is positioned near said first coil.

18. A variable inductor device according to claim 1, wherein an inductance between said input/output external electrodes respectively connected to said first and second coils and an inductance between each of said input/output external electrodes and said tap center electrode are varied by trimming said inductance adjusting element.

19. A variable inductor device according to claim 1, wherein an inductance between said input/output external electrodes respectively connected to said first and second coils is varied by trimming said inductance adjusting element without changing an inductance between each of said input/output external electrodes and said tap center electrode.

20. A variable inductor device according to claim 1, wherein the inductances of said first and second coils are varied at a constant ratio by trimming said inductance adjusting element.

21. A variable inductor device according to claim 1, wherein at least one of a configuration and an inductance of said first coil is different from that of said second coil.

22. A variable inductor device comprising:

an insulating substrate;

at least first and second coils provided on or within said insulating substrate;

a ladder-shaped electrode having at least one horizontal path, said ladder-shaped electrode being provided on or within said insulating substrate and connecting a first end of said first coil to a first end of said second coil, and said ladder-shaped electrode being trimmed to adjust inductance of said first and second coils;

input/output external electrodes provided on or within said insulating substrate and electrically connected to second ends of said first and second coils, respectively; and a tap center electrode provided on or with said insulating substrate and electrically connected to one end of each said first and second coils, respectively.

23. A variable inductor device according to claim 1, wherein the inductor adjusting element comprises a ladder-shaped electrode including a U-shaped frame portion, a plurality of electrode paths extending across said U-shaped frame portion, and at least one groove located between the U-shaped frame member to disconnect the horizontal electrode paths to adjust an inductance between said input/output electrodes in stages.

24. A variable inductor device according to claim 22, wherein said inductances of said first and second coils are varied by substantially a same amount by trimming of said ladder-shaped electrode.

25. A variable inductor device comprising:

an insulating substrate;

at least a first coil and a second coil provided on or within said insulating substrate;

an inductance adjusting element provided on or within said insulating substrate and connecting a first end of said first coil to a first end of said second coil, said inductance adjusting element being arranged to be trimmed to adjust substantially only inductances of the first and second coils;

input/output external electrodes provided on or within said insulating substrate and electrically connected to second ends of said first and second coils, respectively; and a tap center electrode provided on or within said insulating substrate and electrically connected to one of said inductance adjusting element;

wherein said inductances of said first and second coils are varied by substantially a same amount by trimming said inductance adjusting element.

* * * * *